US007309116B2

(12) United States Patent
Garrett et al.

(10) Patent No.: US 7,309,116 B2
(45) Date of Patent: Dec. 18, 2007

(54) DOOR MOUNTED DAIRY COMPARTMENT FOR A REFRIGERATOR

(75) Inventors: Christopher S. Garrett, North English, IA (US); Dennis E. Winders, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 191 days.

(21) Appl. No.: 11/033,530

(22) Filed: Jan. 12, 2005

(65) Prior Publication Data

US 2006/0152122 A1 Jul. 13, 2006

(51) Int. Cl.
*A47B 96/16* (2006.01)

(52) U.S. Cl. ..... 312/405.1; 312/408

(58) Field of Classification Search ..... 62/440, 62/441, 465; 312/405.1, 408
See application file for complete search history.

(56) References Cited

U.S. PATENT DOCUMENTS

| | | | | |
|---|---|---|---|---|
| 4,798,425 | A * | 1/1989 | Armstrong et al. | 312/321.5 |
| 5,193,892 | A | 3/1993 | Swindell | |
| 5,735,589 | A * | 4/1998 | Herrmann et al. | 312/408 |
| 5,765,390 | A | 6/1998 | Johnson et al. | |
| 6,085,542 | A | 7/2000 | Johnson et al. | |
| 6,227,636 | B1 * | 5/2001 | Lye et al. | 312/408 |
| 6,231,146 | B1 * | 5/2001 | Dang | 312/405.1 |
| 2003/0011291 | A1 * | 1/2003 | Moreno-Olguin et al. | 312/405.1 |
| 2003/0024265 | A1 | 2/2003 | Winders et al. | |

FOREIGN PATENT DOCUMENTS

| | | | |
|---|---|---|---|
| EP | 000580962 | | 2/1994 |
| EP | 580962 | * | 2/1994 |
| JP | 405018659 | | 1/1993 |
| WO | WO009808036 | | 2/1998 |

* cited by examiner

*Primary Examiner*—James O. Hansen
*Assistant Examiner*—Philip Gabler
(74) *Attorney, Agent, or Firm*—Michael D. LaFrenz; Kirk Goodwin

(57) ABSTRACT

A refrigerator includes a dairy compartment for supporting items on an inner liner of a fresh food door. The compartment includes a first end section, a second end section and an intermediate section. The intermediate section includes an item support platform and a rear wall. An aperture is formed in one of the central web and the rear wall adjacent the second end. An anchor is mounted to another of the central web and the rear wall adjacent the second end section. The anchor extends through the aperture to hang the compartment on the inner liner of the door with the item support portion in a substantially non-horizontal orientation. The compartment is then rotated such that the item support portion placed in a substantially horizontal orientation whereupon the first end is supported by a lug member formed on the inner liner.

18 Claims, 3 Drawing Sheets

DOOR MOUNTED DAIRY COMPARTMENT FOR A REFRIGERATOR

BACKGROUND OF THE INVENTION

1. Field of the Invention

The present invention pertains to the art of refrigerators and, more particularly, to the mounting of a dairy compartment to an inner liner of a refrigerator door.

2. Discussion of the Prior Art

In the art of refrigerators, it is commonly known to incorporate various shelves and/or compartments on an inner fresh food compartment door for use in storing various food items. Generally, refrigerator fresh food compartment doors are formed from an outer metal shell to which is attached an inner plastic liner. It is known to integrally form such liners with shelf-defining members. For example, it is known in the art to provide a generally horizontally extending shelf or compartment with side walls defined by door dikes to support items on the door. Often times, a closure member extends between the dikes and is pivotable between a compartment access position and a closed position. The use of such a closure member is preferable to prevent items stored in the compartment from becoming dislodged upon a sudden movement of the fresh food compartment door. Typically, such closure members are only associated with dairy compartments provided on refrigerator doors.

In many cases, a dairy compartment is integrally formed as part of the inner door liner. More specifically, it has become common practice to integrally form a tray portion of the compartment at the uppermost portion of the door liner and then pivotally attach a cover to the tray. With this construction, the dairy compartment can be easily dimensioned so as to extend across a desired percentage of the inner door. In other known arrangements, the dairy compartment is formed separate from the inner liner and attached thereto. In general, these types of dairy compartments are designed to extend the full width of the door liner in order to enable the compartments to be supported upon dike portions of the liner. In any case, the known mounting arrangements are quite particular and limit the overall design of the refrigerator door storage system.

SUMMARY OF THE INVENTION

The present invention is directed to the mounting of a compartment on an inner liner of a refrigerator door. In general, the refrigerator includes a cabinet, a liner that defines a fresh food compartment and a door pivotally mounted relative to the cabinet. The door includes an inner liner having first and second dike portions that are separated by a central web. Preferably, each of the first and second dike portions is provided with a plurality of lug members for supporting various vertically height adjustable shelves on an inner portion of the fresh food compartment door.

In accordance with the invention, the compartment includes first and second end sections that are interconnected through an intermediate section. The intermediate section includes an item support portion and a rear wall portion. An aperture is formed in the central web adjacent the second end. In addition, an anchor is mounted to another of the central web and the rear wall portion adjacent the second end. The anchor is designed to extend through the aperture to hang the tray on the inner liner of the door, with the first end of the tray being supported by one of the plurality of lug members.

In accordance with the most preferred form of the invention, the aperture is keyhole-shaped. With this arrangement, the compartment is hung on the anchor and then rotated into position. More specifically, the compartment is hung on the anchor such that the item support portion is initially in a substantially non-horizontal orientation. At this point, the compartment is rotated such that the item support portion shifts to a substantially horizontal orientation. Actually, as the compartment is rotated, the first end is flexed outward so as to clear, and afterwards be supported upon, one of the plurality of lug members on the first dike portion.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
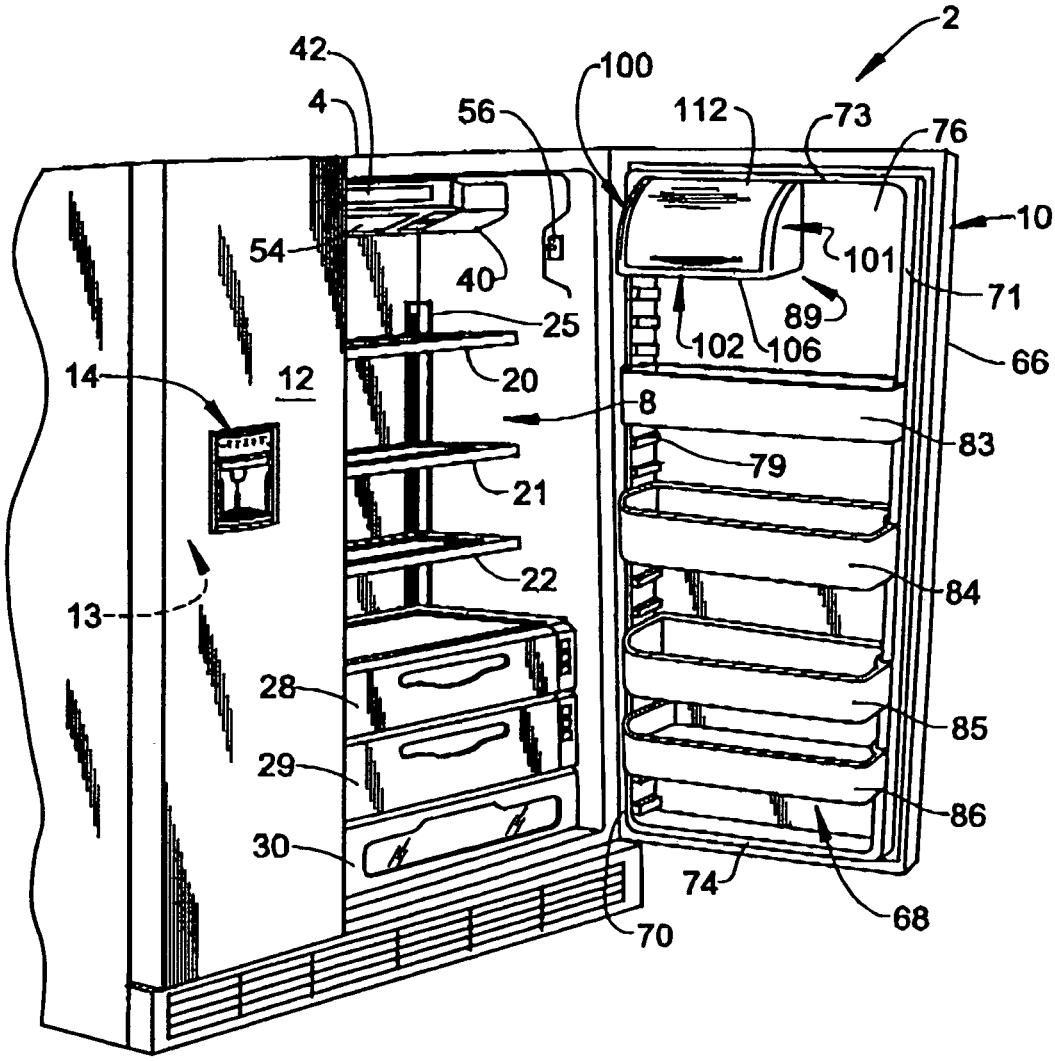
FIG. 1 is a perspective view of a refrigerator incorporating a door mounted compartment constructed in accordance with the present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. In the embodiment shown, freezer door 12 includes a dispenser 14 that enables a consumer to retrieve ice and/or fresh water without accessing fresh food or freezer compartments 8 and 13.

In a manner known in the art, fresh food compartment 8 is provided with a plurality of vertically, height adjustable shelves 20-22 supported by a pair of shelf support rails, one of which is indicated at 25. At a lowermost portion of fresh food compartment 8 is illustrated various temperature controlled bins 28 and 29, as well as a more conventional storage compartment 30. At an upper region of fresh food compartment 8 is a temperature control housing or user interface 40. In the embodiment shown, interface 40 includes a display zone 42 and a plurality of control elements (not shown) for adjusting a temperature of fresh food compartment 8 and/or freezer compartment 13. For the sake of completeness, interface 40 includes a light 54 which, in a manner known in the art, is controlled by a switch 56 operated by opening and closing fresh food door 10.

Figure 2:
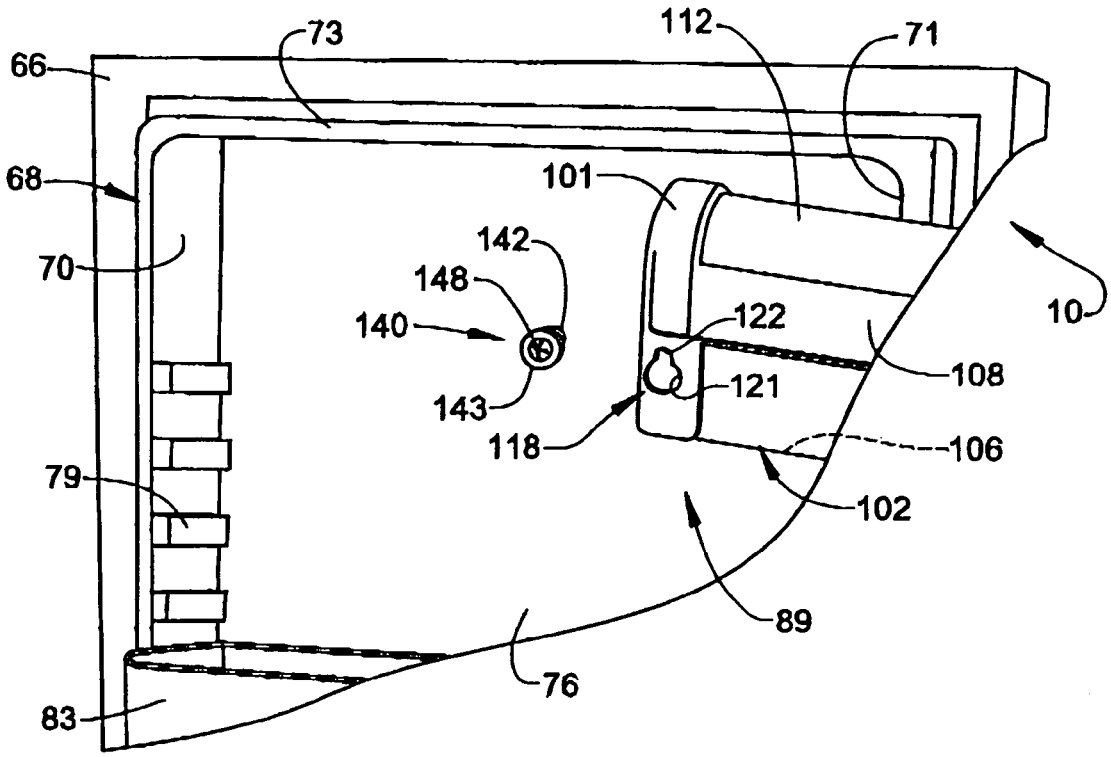
FIG. 2 is a combination cut-away and exploded view illustrating mounting structure for the door mounted compartment.

As best shown in FIGS. 1 and 2, fresh food door 10 includes an outer shell 66 and an inner liner 68. In a manner known in the art, inner liner 68 includes first and second dike portions 70 and 71 which are interconnected by upper and lower dike portions 73 and 74, and a central web 76. In a manner also known in the art, first and second dike portions 70 and 71 are provided with a plurality of lug members, one of which is indicated at 79, for mounting a plurality of vertically height adjustable shelves 83-86. In a manner that will be detailed more fully below, in addition to shelves 83-86, inner liner 68 also supports a compartment 89 at an upper portion thereof.

In accordance with the invention, compartment 89 preferably constitutes a dairy compartment including a first end section 100 that extends to a second end section 101 through an intermediate section 102. Actually, intermediate section 102 constitutes an item support platform 106 and a rear wall portion 108 (see FIG. 2). In general, sections 100-102 collectively constitute a tray of dairy compartment 89. Dairy compartment 89 is also provided with a retractable cover 112 that prevents items from dislodging or falling from item support platform 106 upon a sudden movement of fresh food door 10. As best shown in FIG. 2, dairy compartment 89 is provided with a mounting aperture 118 arranged on rear wall portion 108. More specifically, mounting aperture 118 is formed in rear wall portion 108 adjacent to second end section 101. In accordance with a preferred form of the invention, mounting aperture 118 includes a first or substantially round portion 121 that leads to a second or substantially slotted portion 122 so as to form a generally keyhole shaped opening.

With continued reference to FIG. 2, mounting aperture 118 is designed to receive an anchor 140 mounted on central web 76. Anchor 140 includes a stem portion 142 and a head portion 143 establishing a generally T-shaped profile. As shown, anchor 140 is secured to inner liner 68 with a mechanical fastener 148, such as a screw or the like, extending through a central axis thereof. Actually, the central axis of anchor 140 defines a pivot axis about which compartment 49 pivots into a final position on inner liner 68 in a manner that will be described more fully below.

Figure 3:
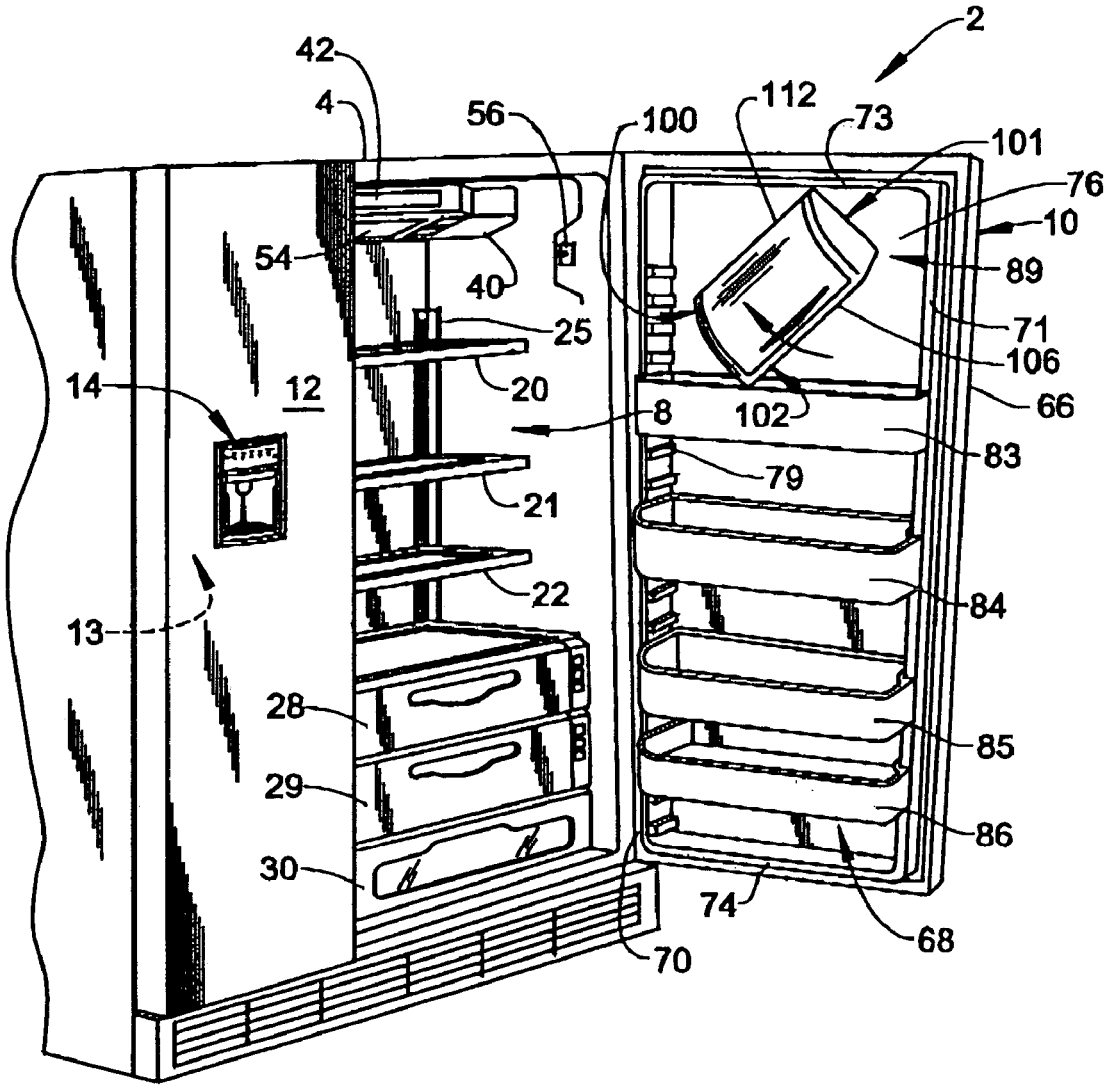
FIG. 3 is a perspective view of the compartment being shifted towards a final supporting position on an inner liner of the door.

In accordance with the most preferred form of the invention, dairy compartment 89 is initially hung on inner liner 68 of fresh food door 10. That is, compartment 89 is positioned such that head portion 143 of anchor 140 extends through first portion 121 of aperture 118 and then compartment 89 is shifted to allow stem portion 142 to slip into slotted portion 121 in order to support first end 101 of compartment 89 with item support platform 106 being in a substantially non-horizontal orientation (see FIG. 3). At this point, compartment 89 is rotated clockwise about a pivot axis defined by anchor 140 until item support platform 106 is in a substantially horizontal orientation as represented in FIG. 1. As compartment 89 is rotated about anchor 140, first end 100 is flexed away from first dike portion 70 of liner 68 so as to clear an uppermost lug member 79. Once in a final position, i.e., when item support platform 106 is in the substantially horizontal orientation shown in FIG. 1, compartment 89 is supported by a respective lug member 79 and anchor 140, with vertical movement being restricted by the presence of upper dike portion 73.

With this particular arrangement, it should be understood that dairy compartment 89, or simply the tray of compartment 89, can be advantageously formed separate from inner liner 68 of fresh food door 10 and efficiently attached to inner liner 68 at a position spaced a significant distance from second dike portion 71. Although described with reference to a preferred embodiment of the invention, it should be readily understood that various changes and/or modifications can be made to the invention without departing from the spirit thereof. For instance, while compartment 89 is illustrated and described as being a dairy compartment, the present invention could also be employed to support other types of tray containing structures, including standard door shelves and bins. In addition, although disclosed for use in connection with a side-by-side refrigerator, the invention can be employed with various refrigerator styles, including top and bottom mount style refrigerators. Furthermore, although the preferred mounting arrangement has the anchor attached to the liner and the aperture formed in the tray, the arrangement could be reverse and the particular type of anchor employed could be readily altered. In fact, a wide range of connection arrangements could be used to attach the tray to the inner liner without departing from the invention. In general, the invention is only intended to be limited by the scope of the following claims.

We claim:

1. A refrigerator comprising:

a cabinet;

a liner arranged in the cabinet, said liner defining a fresh food compartment;

a door pivotally mounted relative to the cabinet, said door including an inner liner having first and second dike portions separated by a central web, each of said first and second dike portions including a plurality of lug members;

a tray for supporting items on the inner liner of the door, said tray including a first end section, a second end section and an intermediate section, said intermediate section including an item support platform and a rear wall portion, wherein the tray extends partially between the first and second dike portions, with the first end section of the tray being supported by one of the plurality of lug members on one of the first and second dike portions and the second end section being supported at the central web of the inner liner;

a single aperture formed on the rear wall portion adjacent the second end of the tray; and a single anchor mounted to the central web said anchor extending through the aperture to hang the tray on the inner liner of the door at the central web.

2. The refrigerator according to claim 1, wherein the anchor includes a stem portion and a head portion so as to establish a generally T-shaped profile.

3. The refrigerator according to claim 2, wherein the anchor is secured to the central web with the head portion spaced from the central web by the stem portion.

4. The refrigerator according to claim 1, wherein the aperture includes a first, substantially round portion that extends to a second, substantially slotted portion so as to form a keyhole-shaped opening.

5. The refrigerator according to claim 1, wherein the anchor is mounted to the inner liner of the door by a mechanical fastener.

6. The refrigerator according to claim 1, wherein the tray forms part of a dairy compartment.

7. The refrigerator according to claim 6, wherein the dairy compartment includes a cover pivotally attached to the tray.

8. A refrigerator comprising:

a cabinet;

a liner arranged in the cabinet, said liner defining a fresh food compartment;

a door pivotally mounted relative to the cabinet, said door including an inner liner having first and second dike portions separated by a central web;

a tray for supporting items on the inner liner of the door, said tray including a first end section, a second end section and an intermediate section, said intermediate section including an item support platform and a rear wall portion; and structure for supporting the tray on the inner liner of the door, said structure including first and second supports, said first support defining a pivot axis adjacent the second end section of the tray about which the tray is rotated until the first end section of the tray is supported by said second support wherein, the first support constitutes an anchor including a stem portion and a head portion so as to establish a generally T-shaped profile.

9. The refrigerator according to claim 8, wherein the second support is provided on the first dike portion.

10. The refrigerator according to claim 9, wherein the second support includes a lug member integrally formed with the first dike portion.

11. The refrigerator according to claim 8, wherein the anchor is secured to the central web with the head portion spaced from the central web by the stem portion.

12. The refrigerator according to claim 8, wherein the first support further includes an aperture formed in the rear wall portion, said aperture having a first, substantially round portion that extends to a second, substantially slotted portion so as to form a keyhole-shaped opening, said anchor projecting into the aperture.

13. The refrigerator according to claim 8, wherein the tray forms part of a dairy compartment.

14. The refrigerator according to claim 13, wherein the dairy compartment includes a cover pivotally attached to the tray.

15. The refrigerator according to claim 8, wherein the second end of the tray is spaced a significant distance from the second dike portion such that the tray only extends partially across the inner liner.

16. A method of supporting a tray on an inner liner of a refrigerator door having an inner liner having first and second dike portions separated by a central web comprising:

providing the tray with a first end and a second end;

inserting a single anchor mounted to the central web and the rear wall portion adjacent the second end of the tray through a single aperture formed in the inner liner of the rear wall portion, the anchor extending through the aperture to hang the tray on the inner liner of the door at the central web such that an item support platform of the tray is initially in a substantially non-horizontal orientation; and rotating the tray about a pivot axis so that the item support platform shifts from the substantially non-horizontal orientation to a substantially horizontal orientation whereupon a second end of the tray is supported by the inner liner of the refrigerator door.

17. The method of claim 16, further comprising: engaging a lug member extending from a dike portion of the inner liner to support the second end of the tray.

18. The method of claim 17, further comprising: flexing the second end of the tray to initially clear the lug member prior to the second end being supported by the lug member.

* * * * *